US005860227A

United States Patent [19]

Perrissoud

[11] Patent Number: 5,860,227

[45] **Date of Patent: *Jan. 19, 1999**

[54] SPORT BOOT WITH ADJUSTABLE UPPER

[75] Inventor: Claude Perrissoud, Saint-Jorioz, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 799,626

[22] Filed: Feb. 12, 1997

[30] Foreign Application Priority Data

Feb. 19, 1996 [FR] France ..... 96 02173

[51] Int. Cl.[6] ..... A43B 5/04

[52] U.S. Cl. ..... 36/118.3

[58] Field of Search ..... 36/118.3, 118.4, 36/118.8, 119.1, 117.5

[56] References Cited

U.S. PATENT DOCUMENTS

| | | | |
|---|---|---|---|
| 4,539,764 | 9/1985 | Pradier | 36/121 |
| 4,570,364 | 2/1986 | Walkhoff | 36/121 |
| 4,601,118 | 7/1986 | Zanatta | 36/120 |
| 4,615,128 | 10/1986 | Borsoi | 36/120 |
| 5,259,127 | 11/1993 | Pallatin | 36/117 |

FOREIGN PATENT DOCUMENTS

| | | |
|---|---|---|
| 0117430 | 9/1984 | European Pat. Off. . |
| 0150800 | 8/1985 | European Pat. Off. . |
| 0364400 | 4/1990 | European Pat. Off. . |
| 0406212 | 1/1991 | European Pat. Off. . |
| 2682571 | 4/1993 | France . |
| 2682859 | 4/1993 | France . |

OTHER PUBLICATIONS

"Lange '72" brochure, showing the Lange Pro ski boot.

"New in '72–'73 from Lange" brochure, showing the Lange Pro ski boot.

"Caber 1981–82" brochure, showing the Caber Equipe ski boot.

"Nordica Ski Boot Collection 94–95", showing the Grand Prix Line ski boots.

*Primary Examiner*—Ted Kavanaugh
*Attorney, Agent, or Firm*—Greenblum & Bernstein, P.L.C.

[57] ABSTRACT

Sport boot including a device for coupling the upper to the shell base. The coupling device has two coupling assemblies that are removable and replaceable by coupling assemblies with different mechanical characteristics which connect the upper to a collar extending from the shell base. These coupling assemblies are arranged on both sides of the dorsal zone of the boot on fixing points located behind the journal axes of the upper, and at a distance above such axes. The sport boot according to the invention is adaptable by the user, in order to provide it with technical characteristics that are specific to a sport activity, in a simple and reversible manner.

23 Claims, 4 Drawing Sheets

14 A
15
13
14 B
15
21
20
13
14 C
15
13
10
16
13
14
15
11
1
17
17
5
12
6a
10
13
16
36
6b
4
9
2
22
11
X
18
8
39
6
3
4

SPORT BOOT WITH ADJUSTABLE UPPER

BACKGROUND OF THE INVENTION

1. Field of the Invention

The invention relates to a sport boot constituted by an upper and a shell base connected and journalled to one another in the zone corresponding to the joint of the wearer's ankle, and its object is a device for coupling the upper to the shell base in the dorsal area of the boot. This device is adapted to determine the bending conditions of the upper with respect to the shell base.

2. Background and Material Information

Known boots of this type, especially ski boots, generally have an upper and a shell base that are journalled to one another about linkage axes in the zone corresponding to the wearer's ankle, where they are joined by at least a partial nesting on one another. Conventionally, the nesting is made through the lower edge of the upper that covers a collar formed by an extension of the wall of the shell base, which ensures a proper imperviousness. This collar, which is more or less flexible and high, is centered in the dorsal zone of the heel of the shell base on both sides of the journal axes of the upper, on the one hand, and is associated with a transverse edge on which the lower edge of the upper takes support when the upper is pivotally rearwardly biased, on the other hand. The junction zone thus arranged between the upper and the shell base makes it possible to limit the rearward bending of the upper and opposes a certain resistance to its forward bending. Indeed, because it covers the collar extending from the shell base, its forward pivoting is made possible only if the elastic deformation of the collar is induced, at least in the zone comprised between its journal axes and the dorsal zone of the heel of the shell base, and if the frictional forces resulting therefrom are overcome. To this end, the force applied on the front portion of the upper, in correspondence with the tibial zone of the skier, must be greater than the resisting force provided by the collar which cooperates with the rear portion of the upper; this collar therefore constitutes a means for controlling the bending during the stress. Furthermore, since the collar is encircled by the lower rear edge of the upper on both sides of the journal axes thereof, the resultant force produced to cause its forward bending is obliquely transmitted from the upper toward the tip of the shell base along a direction that is always oriented substantially perpendicular to the journal axes of the upper, i.e., practically always in the longitudinal axis of the boot. The collar thus associated with the journal axes of the upper therefore constitutes a means for controlling the bending of the upper that occurs in the direction of the force transmitted toward the shell base.

These boots are relatively satisfactory because they have a very simple structure and are relatively impervious, easy to manufacture and, therefore, inexpensive, and because the flexibility of the upper therein is progressive during the stress and is obtained by a pulling effect on the dorsal zone of the boot, which is a factor of comfort for the skier. Of course, in so doing, the force applied on the front portion of the upper by the skier is distributed over a large enveloping surface extending along the tibial zone and on both sides thereof, resulting in the absence of a hard spot or localized pressure, which are often noticed on boots in which the resisting force is obtained by a pushing effect on the front portion of the boot, between the upper and the shell base.

However, the performance level of these boots remain insufficient when intended for experienced skiers who wish to master and refine their technique for competition, cross country skiing on any snow, or exhibition skiing, and mostly for transmitting maximum power, i.e., of force, in their supports on the upper to optimize the pressures of ski-snow contact, directional effects, etc.

It is thus noted, for example, that the upper of these boots is really not limited in forward pivoting, especially for preventing accidents following an extreme dorsal bending or dorsibending of the skier's ankle, such as rupture of ligaments, tendons, or tear of muscles. Indeed, nothing firmly opposes the forward pivoting of the upper, in fact, the upper reaches its bending limits only when the front lower edge takes support on the opposing portion of the shell base, i.e., that which corresponds to the instep zone, by deforming it, if necessary, so that the resistance opposed by the latter reaches a level that is capable of stopping its the upper in pivoting. As a result therefrom, the bending limit of the upper in these boots is variable as a function of the force applied on the upper and, at any event, it determines an excessive bending amplitude that can be traumatizing for the wearer.

Another disadvantage is related to the difficulty in obtaining a substantial force to resist the forward bending of the upper by simply varying the thickness, height and flexibility of the collar coming from the shell base. Indeed, in view of the fact that this collar is located in the area where the foot passes during the fitting and removal of the boot, it must be sufficiently flexible to move away under the mere pressure from the foot during the passage thereof, without any other intervention; likewise, it must not extend too high in the dorsal zone of the shell base in order not hinder the engagement-disengagement of the heel of the skier's foot, still during the fitting-removal of the boot.

Still another disadvantage is related to the absence of any adjustment, whether for varying the bending stress of the upper, its advance angle, the direction of the resultant force which it transmits toward the shell base, or for the amplitude of its possible bending.

To palliate some of these disadvantages without calling into the question the simplified structure of these boots that are provided with all necessary means to ensure control of the bending, even if they are insufficient as disclosed hereinabove, a known solution consists of using it as a base structure to which means for reinforcing and retaining the upper on the collar are added. That is what is obtained, for example, on the 1972 Lange "PRO", 1982 Caber "Equipe" and 1995 Nordica "Grand Prix" alpine ski boots. Indeed, on these boot models, whose base structure is comparable to that of the previously described boots, the reinforcement is obtained by means of at least two coupling means ensuring a fixed and permanent connection between the upper and the collar. These coupling means are arranged on both sides of the dorsal zone of the heel of the shell base and of the upper, in a symmetrical manner, and in the space comprised between the journal points of the upper and the dorsal zone. With this arrangement of the coupling means, the upper of the boot is blocked, i.e., prevented from any predetermined pivoting, and the bending forces which are applied thereto by the lower part of the skier's leg are thus transmitted in the direction of the shell base with a minimum of power loss and briefly, even quasi instantaneous, because the only bending amplitude of the upper now only results from the deformation of the materials used.

In addition, since the coupling means are located in the dorsal zone of the boot and on both sides thereof, the force resisting the forward bending of the upper is still obtained by a pulling effect, which relatively preserve the tibial zone of the skier's leg. It is obvious that the arrangement of at least two or more coupling means, such as obtained on these boots, makes it possible to reduce the pressures in their location, as well as the risks of deterioration.

Therefore, with respect to the boots previously described, these boots have a substantial bending strength and practically no bending amplitude, which is relatively satisfactory for the experienced skiers but, consequently, these boots are not suitable for all skiers because they are too specific, especially in rigidity, without any possibility of adjustment whether for the bending stress, the advance angle, the bending amplitude, or the direction of the force transmitted to the ski by the inserted shell base.

As a result from the above analysis, the sport boots having a simplified structure as described previously, are generally satisfactory for the user as long as they are used within their specificity, i.e., for spare-time and leisure sport activity or for a very technical sport activity such as competition. Indeed, the reinforcement of the bending strength of the upper of these boots, via fixed and permanent coupling means, cannot be performed by the user of the boot and is not reversible or adjustable for a subsequent adaptation, in view of increasing the bending amplitude of the upper, for example. To satisfy the largest number of users of these boots, it is therefore necessary to provide a large number of models corresponding at least to the various estimated categories of users, and to provide each model with specific characteristics that meet, at best, the requirements of these categories. Obviously, this process is complicated, expensive due to the necessity of having numerous models, and only provides an average technical solution for the user because it is based on a "category of users" and does not really allow for a personalization of the boot.

SUMMARY OF THE INVENTION

An object of the present invention is to remedy the disadvantages that are specific to the sport boots described hereinabove, and its object is to enable the user himself to provide them, in a very simple, efficient and reversible manner, with additional technical characteristics specific to the sport for which he wishes to use the boots.

Another object of the invention is to propose a single model of boot with a simplified structure which is compatible with a plurality of user categories, even all of the users in the considered sport activity.

To achieve these objectives, the sport boot has a base structure constituted by an upper and a shell base connected and journalled to one another in the zone corresponding to the joint of the wearer's ankle, where they are joined by at least a partial nesting on one another via the lower edge of the upper and by a collar of the shell base, and includes a device for coupling the upper to the shell base, such device being constituted by two coupling means arranged on both sides of the dorsal zone of the boot on fixing points. It is characterized in that the coupling means are removable and replaceable by other coupling means, especially by means having different mechanical characteristics.

With this removability characteristic of the coupling means, the boot having a simplified base structure can easily be adapted by the user, either by removing the coupling means for a spare-time and leisure sport activity, or by using the coupling means for a very technical sport activity, such as competition.

Still due to the removability of the coupling means located on both sides of the dorsal zone of the boot and behind the journal and linkage axis of the upper, it is also possible to modify the direction of the resultant force transmitted from the upper toward the shell base during the bending. Indeed, to do this, it suffices to use only one of the two means for coupling the upper to the collar of the shell base, which, as a consequence, only reinforces the flank of the boot where the coupling means is located, i.e., in the zone comprised between the latter and the corresponding journal axis of the upper. With this arrangement, the bending stresses applied on the upper are obliquely transmitted by the latter toward the shell base along a direction that is no longer oriented as a function of the position of its two journal axes, but as a function of the dissymmetrical position of the single coupling means used with respect to the two journal axes. As a result, the orientation given to the resultant force applied on the upper diverges with respect to the longitudinal axis of the boot on the side corresponding to the reinforced blank, during forward or rearward bending.

This possibility of modifying the direction of the resultant force transmitted by the upper proves very interesting because it enables the skier, for example, to increase the pressure on only one of the edges of the sole of the shell base, and consequently, on the corresponding running edge of the ski when skiing. It is obvious that such a dissymmetrical coupling that increases the lateral pressure is preferably obtained on the inner side of each boot, because it is mostly on the inner running edge of the skis that the skiers needs to transmit the most substantial forces, especially for the gripping of the ski or to optimize certain directional effects, for example.

According to different embodiments, the boot is also characterized in that the fixing points of the two coupling means are located on both sides of the dorsal zone of the boot upper, either symmetrically, or dissymmetrically, depending upon whether one wishes or not to provide the boot with an originally provided particular behavior. In the first example of construction, for example, the simultaneous use of the two coupling means provides a resultant force, transmitted by the upper, that is always oriented along a direction substantially perpendicular to the journal axes of the latter. Conversely, in the second example of construction, the simultaneous use of the two coupling means always produces a resultant of the force transmitted which is more directed toward the flank of the boot where the reinforcement is the most substantial, which results in orienting it in a direction that is always substantially divergent with respect to the longitudinal axis of the boot. It is obvious that even in this embodiment, one can only use one coupling means to further increase the divergence of the resultant force transmitted by the upper toward the shell base with respect to the longitudinal axis of the boot.

According to an embodiment of the coupling device, each coupling means is constituted by a shouldered washer hole-punched in its center and adapted to cooperate, through its shoulder, with a slot obtained in the wall of the upper, on the one hand, and by a removable assembly element, such as a screw or a threaded pin, extending transversely to the walls of the collar of the shell base and of the upper which it crosses by passing through the hole of the washer. The coupling of the upper to the collar of the shell base is thus carried out by means of the assembly element which makes it possible to sandwich the wall of the upper between the shouldered washer and the wall of the collar, whereas the shoulder, housed in the slot of the upper, limits the possible movements thereof on its journal axes with respect to the assembly element that is fixedly positioned on the collar of the shell base.

This construction of each coupling means shows that it suffices to modify the adjustment of the shoulder of the washer with respect to the slot with which it cooperates to enable a corresponding relative displacement of the upper with respect to the collar, by pivoting about its journal axes, or to block the latter, and therefore to modify the bending amplitude. In fact, the external contour of the shoulder of the washer is provided to be smaller than the internal contour of the slot, and preferably on the side where the relative displacement is desired. The clearance value, or space, which is left free between the shoulder and the slot thus determines the allowed maximum relative displacement value of the upper with respect to the shell base on each boot flank that is considered. Still on the basis of this type construction of each coupling means, it also suffices to insert an elastically compressible material between the free space between the shoulder and the slot in order to dampen the relative displacement of the upper, and therefore to vary the bending stress. To enable the user of the boot to act himself on these parameters, and to thus provide the boot with the technical characteristics which he desires, a set of washers, with shoulders of various sizes and/or shapes, which can always be housed in the slots provided originally in the boot upper, is provided and made available to the user. Thus, by replacing one type of washer by another type on each flank of the boot, the bending conditions of the upper with respect to the shell base are modified.

According to a preferred embodiment, the boot upper has, on each flank, an oblong slot that is oriented on a tangent generated from the corresponding journal axis of the upper, and the set of shouldered washers includes three types: the first includes an off-centered oblong shoulder that is adjusted to that of the oblong slot, the second has a shoulder similar to the first but is constituted by a rigid material and of an elastically compressible material, the rigid material extending in the location of the passage hole for the assembly element, and the third type has a centered cylindrical shoulder with a substantially smaller diameter than the width of the oblong slot. Thus, depending on the shouldered washer used, one obtains:

the blocking of the upper in the two bending directions, forward and rearward and, by turning the washer by 180°, a modification of the advance angle of the upper for the value by which the shoulder is off centered;

the blocking of the upper in one bending direction, forward or rearward, and a dampened bending in the other bending direction, within the limits allowed by the oblong slot and the compressibility of the shock absorbing material; or the blocking of the upper in the forward or rearward bending direction, and a free bending in the other bending direction, within the limits allowed by the oblong slot.

Since, the mounting of these washers is independent from one flank to the other of the boot, it is understood that a multitude of symmetrical and dissymmetrical combinations are therefore allowed, which enables the user to specifically adapt the behavior of the boot as desired and to the anticipated sport activity.

BRIEF DESCRIPTION OF DRAWINGS

The invention will be better understood upon reading the description that follows, with reference to the annexed schematic drawings showing, by way of an example, an embodiment of a sport boot, such as a ski boot, equipped with a coupling device that is adjustable on the upper, and in which.

DETAILED DESCRIPTION OF THE PREFERRED EMBODIMENTS

Figure 1:
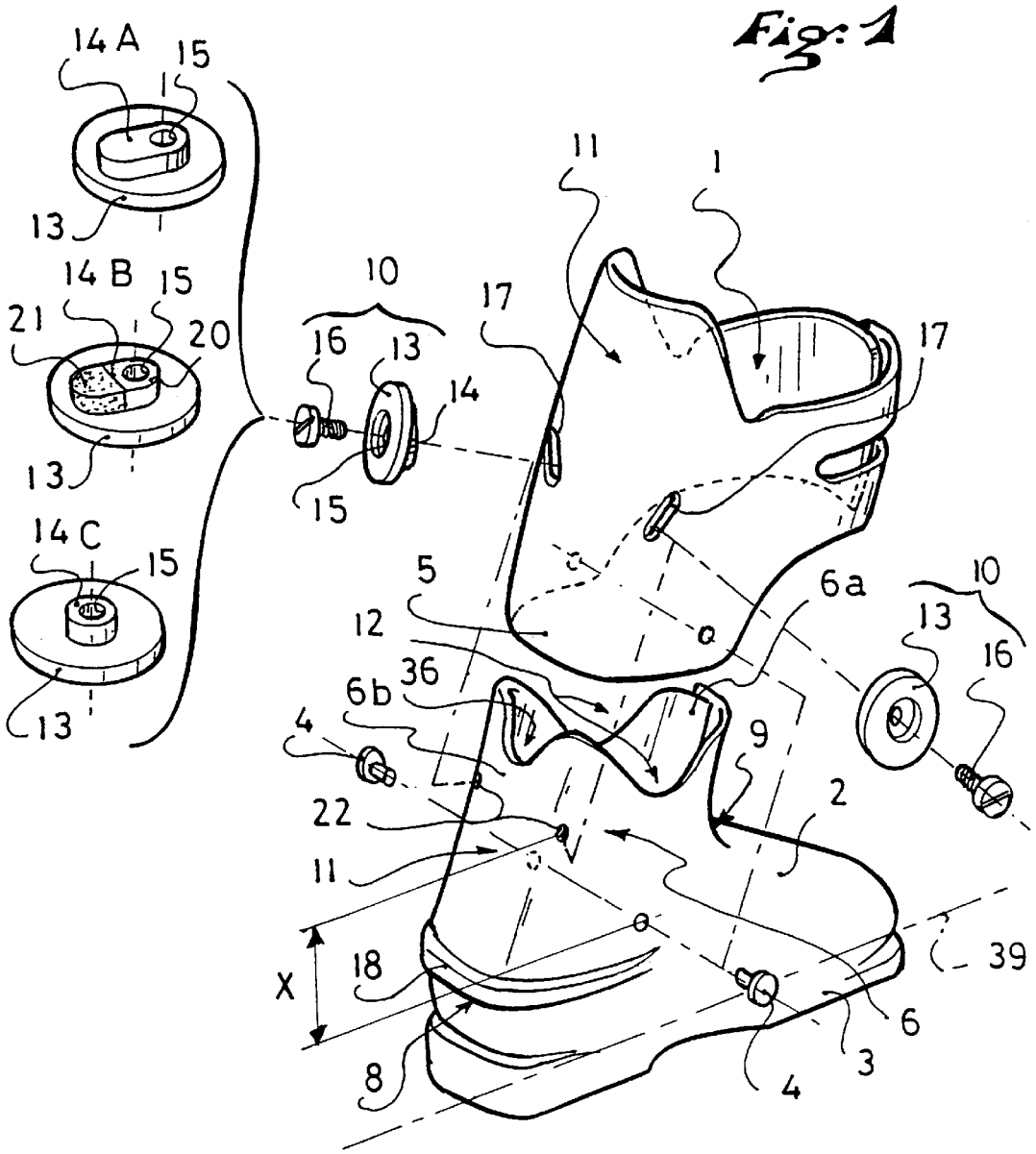
FIG. 1 is an exploded view of a ski boot provided with a device for coupling its adjustable upper by means of a set of coupling means of different types.
Figure 2:
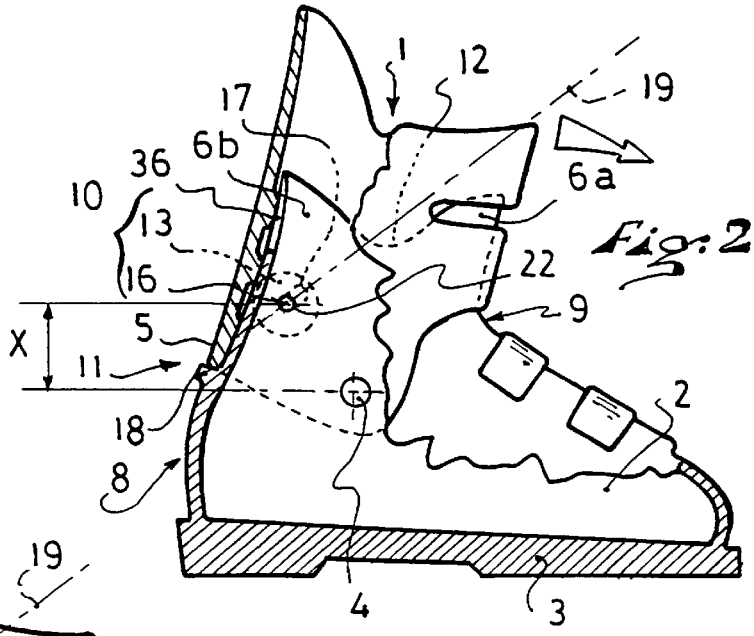
FIGS. 2 and 3 show a partial longitudinal cross-sectional view of the boot of FIG. 1 in a first advanced position (FIG. 2) and in a second advanced position (FIG. 3)
Figure 3:
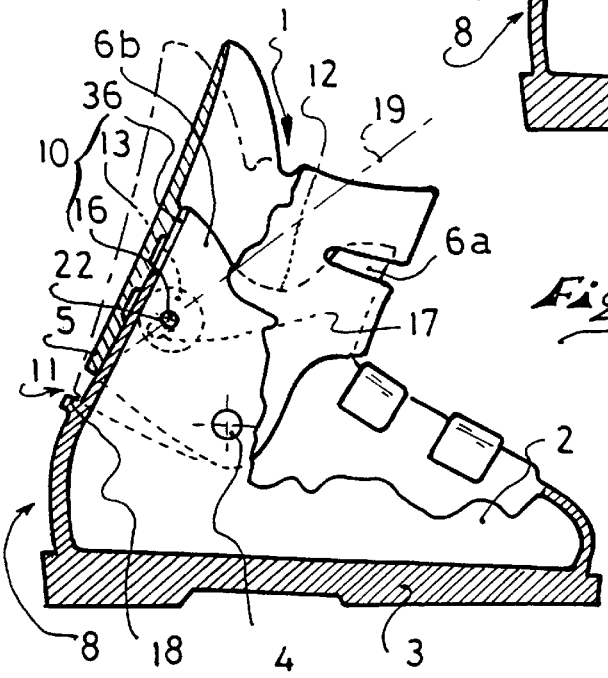
Figure 4:
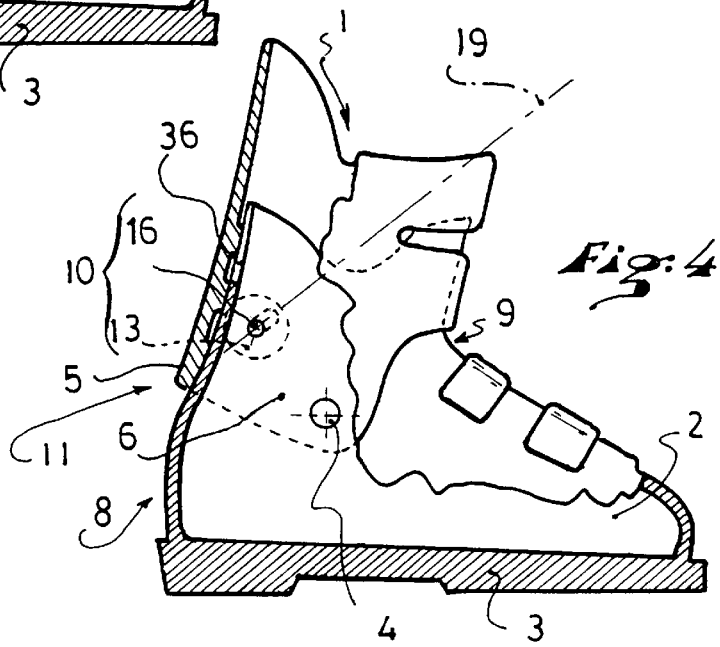
FIG. 4 shows a ski boot similar to that of FIGS. 1–3 but whose shell base does not include any rear support edge.

The ski boot shown in FIGS. 1–3 has a structure that is constituted by an upper 1 and a shell base 2 provided with a walking sole 3. The upper 1 and the shell base 2 are connected and journalled to one another at the medial and lateral sides of the upper and shell base about respective axes by means of journals 4 located in the zone corresponding to the joint of the wearer's ankle (not shown), and are limited in rearward pivoting by a support edge 18. These portions 1 and 2 are joined by at least a partial nesting of one 1 on the other 2 of the boot via the lower edge or portion 5 of the upper 1 and a collar 6 of the shell base 2, which extend at least above the heel 8, and possibly above the instep 9, as in the example shown. In this latter case, two lateral notches 12 separating the front portion **6*a* from the rear portion 6*b* of the collar 6 are advantageously provided to facilitate the elastic deformation of the collar 6 when the upper 1 bands on the front. Likewise, in order not to hinder the passage of the heel of the skier's foot, both for fitting and removing the boot, another notch 36 is made in the dorsal upper end of the collar 6**.

A coupling device constituted by two coupling means or assemblies 10 arranged on both sides of the dorsal zone 11 of the boot makes it possible to connect the upper 1 and the shell base 2 to one another at fixing or attachment points 22 located symmetrically behind the journal axes 4, and above the latter at a certain distance referenced by the letter "X", such as shown. Of course, these fixing points 22 can be provided to be positioned dissymmetrically, whether upwardly and/or laterally. This device is characterized by the fact each coupling means 10 is removable and/or replaceable by other coupling means 10 capable of having different mechanical characteristics. Each coupling means or assemblies 10 is constituted by a washer 13 with a shoulder 14 bored with a hole 15 in its center (the combination of elements 13, 14, 15 comprising a coupling device), and by an assembly element 16, such as a screw, which enables a removable assembly.

This assembly element 16 extends transversely to the walls of the collar 6 of the shell base 2 and of the upper 1 which it crosses through a slot or opening 17 thereof, and passes through the hole 15 of the washer 13 whose shoulder 14 is housed in the slot 17. The coupling of the upper 1 on the collar 6 of the shell base 2 to the coupling means 10 described causes the wall of the upper 1 to be sandwiched between that of the collar 6 and the washer 13, and limited in pivoting on its journal axes 4 as a function of the clearance or space left free between the outer contour or periphery of the shoulder 14 and the contour or periphery of the slot 17. It appears from this arrangement of coupling means 10 that one can not only replace them, or put only one to use, but that they can also be removed; in this latter case, these basic functional characteristics are restored in the boot, i.e., the upper 1 can bend forwardly, provided that the resistance opposed by the collar 6 through its elastic deformation is overcome, and is blocked rearwardly, as soon as it takes support on the edge 18 of the shell base 3.

In the present embodiment, the opening 17 obtained in the upper 1 is oblong and oriented on a tangent, which is referenced by the numeral 19 (see FIGS. 1–4) and generated from the corresponding journal axis 4 of the upper 1, and the shoulder 14 of the washer 13 is adapted. To this end, the washer 13 is, for example, provided according to three different types of construction having shoulders 14, versions A, B or C, visible in FIG. 1, that are made available to the wearer of the boot:

in version A, the shoulder 14 is oblong and off-centered with respect to the hole 15, and its contour is adjusted to that of the slot 17, the shoulder being preferably made of a rigid material;

in version B, the shoulder 14 has a shape identical to that of version A, but is made of two materials, i.e., constituted of a rigid material in the area 20 of the passage hole 15, and of an elastically compressible material for the remainder, referenced by the numeral 21;

in version C, the shoulder 14 is cylindrical and centered on the passage 15, and it has a substantially smaller outer diameter than the width of the oblong slot 17.

The user thus has three coupling means 10A, 10B, and 10C, with different mechanical characteristics, each of which influences the bending possibilities of the upper and, in addition, is capable of being used according to two opposed 180° positions, which determine the direction of possible displacement bestowed to the upper 1.

By way of example, FIGS. 5–11 illustrate a detailed view of the implementation of the three coupling means 10 according to versions A, B, and C, and of the incidence of their 180° rotation.

Figure 5:
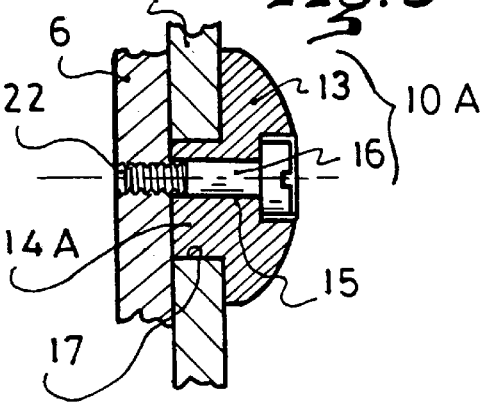
FIGS. 5–11 show a cross-sectional view, along the line V—V of FIG. 2, of the different possibilities for mounting the coupling means and their functioning.
Figure 6:
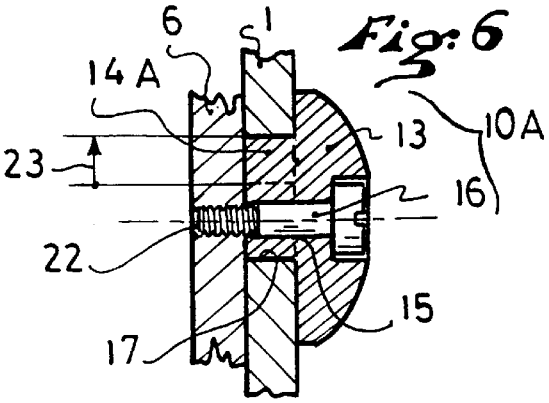

In FIGS. 5 and 6, which correspond to the positions of the boot illustrated in FIGS. 2 and 3, the shoulder 14A of the coupling means 10A totally fills the slot 17 and thus prevents any displacement of the upper 1 with respect to the collar 6 of the shell base, by means of the assembly element 16 which is fixedly positioned on its fixing point 22. Furthermore, with its 180° rotation, from the position shown in FIGS. 5 and 2 to that of FIGS. 6 and 3, the washer 13 of the coupling 10A requires the displacement of the slot 17 of the upper 1 on the side where the shoulder 14A is off-centered, so that the slot 17 is located across from the shoulder 14A. Because of this displacement, the "advance angle" or "inclination" of the upper 1 with respect to the shell base 2 is modified for the value by which the shoulder 14A is off-centered, as indicated by arrow 23. It is understood that in such example of assembly, the rear support edge 18 has no influence on the upper 1, and that its absence, as shown on the boot of FIG. 4, does not hinder the behavior of the boot. On the contrary, the removal of the two coupling means 10 totally releases the upper during bending, even rearwardly, and in this case, the absence of a rear support edge 18 can constitute a handicap for the skier, especially for his or her front-to-rear balance.

Figure 7:
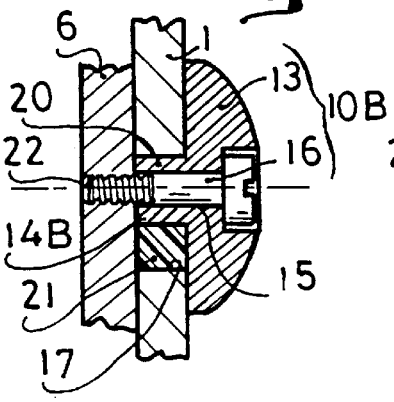
Figure 8:
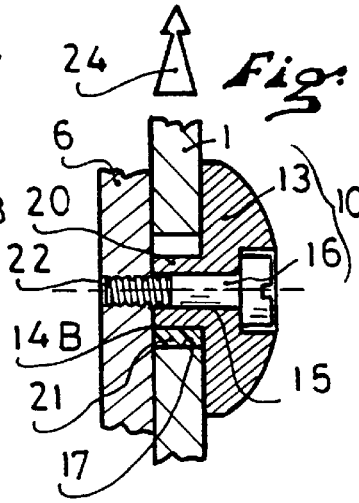
Figure 9:
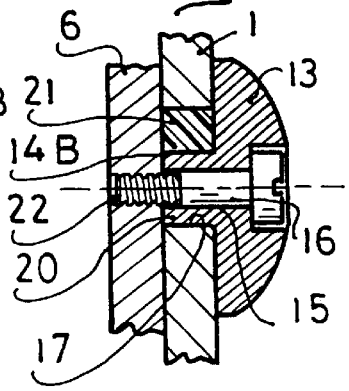

In FIGS. 7, 8, and 9, the shoulder 14B of the coupling means 10B totally fills the slot 17 as is the case for means 10A, but because it includes a compressible portion 21, a certain displacement with respect to the fixing point 22 remains possible for the upper 1 within the compressibility limits of the portion 21, as indicated by arrow 24 in FIG. 8, from the initial position of FIG. 7. It is to be understood that the 180° rotation of the washer 13 requires, as previously for the shoulder 14A, the displacement of the upper 1 about its axes 4 in order to bring the slot 17 back across from the shoulder 14B, as shown in FIG. 9. On the contrary, the upper, in this case, maintains a certain freedom of displacement on the side where the compressible portion 21 of the shoulder 14B is located. Thus, a shock absorption can be selectively obtained for the upper 1 during forward or rearward bending, along the direction of assembly of the coupling means 10B.

Figure 10:
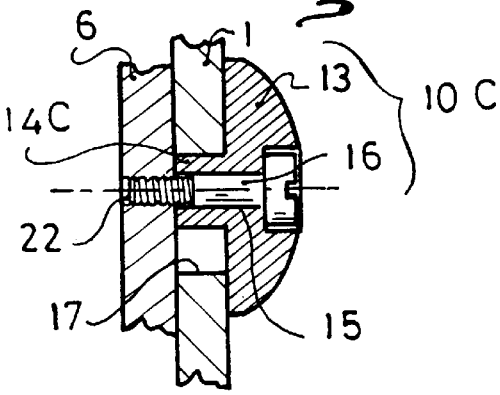
Figure 11:
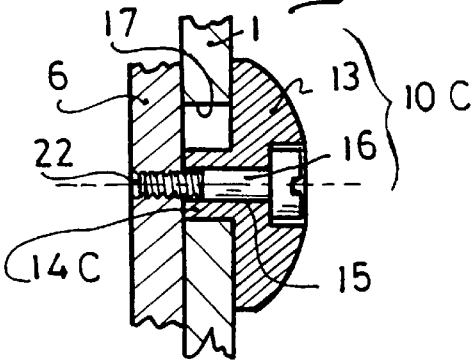

In FIGS. 10 and 11, the cylinder shoulder 14C of the coupling means 10C constantly leaves a certain free space between it and the ends of the oblong slot 17, and thus enables the upper 1 to move freely about its journal axes for an amount corresponding to the dimension of this space, the shoulder 14C constituting the abutment means during extreme forward and rearward bending.

From the above description, it appears that the user can use a selected coupling means, 10, 10A, 10B, or 10C, on one flank of the boot, and a different coupling means on the other flank of the boot. The user can also use a single coupling means 10, 10A, 10B, or 10C. For all of the examples of assembly mentioned, it appears clearly that the forward and/or rearward bending of the upper than generates different effects which cooperate in the direction of the resultant force transmitted from the upper 1 toward the shell base 2, the level of forces, the dampening of the bending, the bending amplitude, and/or the angle of advance of the upper 1.

Figure 12:
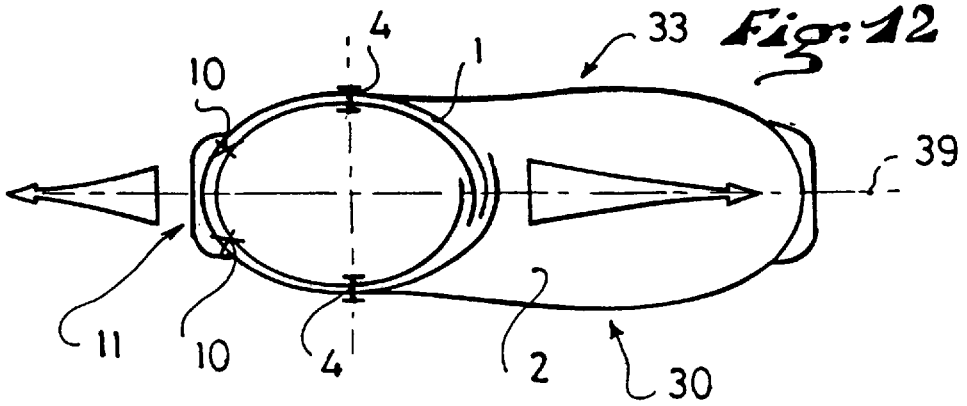
FIGS. 12–14 schematically show certain directional effects that the coupling device can provide in the transmission of forces from the upper toward the shell base, depending upon whether its coupling means are mounted symmetrically or dissymmetrically.

Thus, as in the example illustrated in FIG. 12, when the coupling means 10 are symmetrically arranged on both sides of the dorsal zone 11 and of its journal axes 4, the direction of the transmitted resultant force is substantially perpendicular to the journal axes 4, as indicated by arrows 28 and 29, depending upon whether the bending is forward or rearward, i.e., substantially along the longitudinal median slant 39 of the boot.

Figure 13:
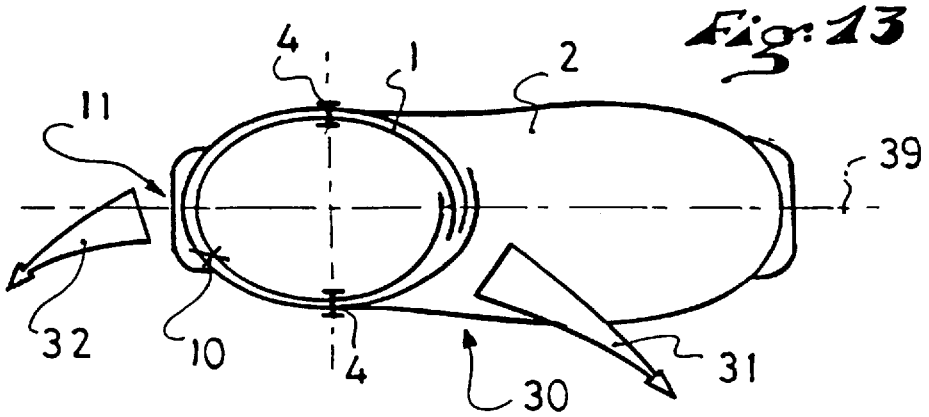

In the case of FIG. 13, the use of a single coupling means 10 on the external, or lateral, side 30 of the boot is illustrated. In this case, only the flank corresponding to this side 30 is reinforced in the zone comprised between the axis 4 and the coupling means 10. Consequently, the bending stresses exerted on the upper 1 of the boot toward the front or rear generate a lateral torque which orients the direction of the resultant force toward this reinforced side of the boot, i.e., the external side 30, as indicated by arrows 31 and 32, and therefore in a divergent manner with respect to the longitudinal plane 39 of the boot.

Figure 14:
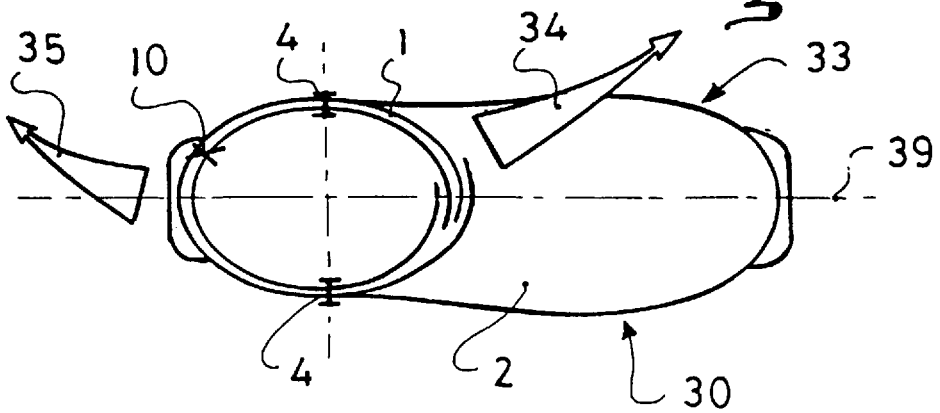

Conversely, in the case of FIG. 14, the use of a single coupling means 10 on the internal, or medical, side 33 of the boot is illustrated. In this case, the direction of the resultant force, which is always oriented toward the reinforced side of the boot, is then directed, as indicated by arrow 34, toward the internal side 33. This dissymmetrical coupling is of course more interesting than the previous one, because it increases the force transmitted on the internal side of the boot which corresponds to that of the internal running edge of the skis where the forces and supports must be most substantial for the gripping of the ski, and/or to optimize certain directional effects, especially in turns.

The instant application is based upon the French Priority Application No. 96.02173, filed on Feb. 19, 1996, the disclosure of which is hereby expressly incorporated by reference thereto, and the priority of which is hereby claimed under 35 U.S.C. §119.

What is claimed:

1. A sport boot comprising:

a shell base and an upper extending upwardly from said shell base, a lower portion of said upper being at least partially nested on an upper portion of said shell base, each of said shell base and said upper having medial and lateral sides;

journals connecting said shell base and said upper at said medial and lateral sides in an area corresponding to a wearer's ankle, said journals defining a journal axis of said upper of the boot;

two removable coupling assemblies, coupling said upper to said shell base, each of said two coupling assemblies being arranged rearward of a respective one of said journals, said two coupling assemblies being arranged on opposite sides of a longitudinal median plane of the boot, each of said removable coupling assemblies being adapted to be removed and replaced with any of other coupling assemblies having different mechanical characteristics.

2. A sport boot according to claim 1, wherein:

said two removable coupling assemblies are positioned symmetrically on respective sides of a rear zone of said upper.

3. A sport boot according to claim 1, wherein:

said two removable coupling assemblies are positioned asymmetrically on respective sides of a rear zone of said upper.

4. A sport boot according to claim 1, wherein:

said two coupling assemblies are arranged above said journals.

5. A sport boot according to claim 1, wherein:

said upper comprises two slots extending through a wall of the upper on opposite sides of the longitudinal median plane of the boot;

each of said two coupling assemblies comprises:

a washer having a center, a hole extending through said center, and a shoulder; and a removable assembly element;

each of said shoulders is positioned in a respective one of said two slots of said upper, each of said removable assembly elements extends through a hole of a respective washer and through a respective slot of said upper and is affixed to a respective attachment point on said upper portion of said shell base.

6. A sport boot according to claim 5, wherein:

each of said slots has a predetermined internal periphery;

said shoulder of at least one of said washers has an external periphery less than said predetermined internal periphery of a respective one of said slots, whereby a free space is positioned between said shoulder of said at least one of said washers and said predetermined internal periphery of said respective one of said slots, said free space having a dimension defining a dimension of relative displacement of said upper with respect to said shell base on a respective side of said longitudinal median plane of the boot.

7. A sport boot according to claim 5, wherein:

each of said slots is elongated in a direction along a tangent generated from a respective one of said journals along said journal axis of said upper.

8. A sport boot according to claim 7, wherein:

said shoulder of at least one of said washers is centered and cylindrical, said cylindrical shoulder having a diameter less than a width of a respective one of said two slots.

9. A sport boot according to claim 8, wherein:

each of said coupling elements comprises a screw.

10. A sport boot according to claim 5, wherein:

said shoulder of at least one of said washers is made of a rigid material.

11. A sport boot according to claim 10, wherein:

said shoulder of at least one of said washers has an elongated shape made of a rigid material.

12. A sport boot according to claim 5, wherein:

each of said slots is elongated;

said shoulder of at least one of said washers has a part made of a rigid material and a part made of an elastically compressible material; and said hole extends through said rigid part of said shoulder.

13. A sport boot according to claim 1, wherein:

each of said two removable coupling assemblies comprises an assembly element having means for facilitating removal of a respective coupling assembly.

14. A sport boot according to claim 1, wherein:

both of said coupling assemblies are identical in shape and mechanical characteristics.

15. A sport boot according to claim 1, wherein:

said coupling assemblies have different shape.

16. A sport boot according to claim 1, wherein:

said coupling assemblies have different mechanical characteristics.

17. A sport boot according to claim 1, further comprising:

said other coupling assemblies, whereby the wearer can arrange coupling assemblies having different mechanical characteristics on respective ones of said opposite sides of the longitudinal median plane of the boot.

18. A sport boot according to claim 1, wherein:

said upper portion of said shell base comprises a collar; and said two removable coupling assemblies couple said collar of said shell base to said upper at a rear zone of the boot.

19. A sport boot comprising:

a shell base and an upper extending upwardly from said shell base, a lower portion of said upper being at least partially nested on an upper portion of said shell base, each of said shell base and said upper having medial and lateral sides;

journals connected said shell base and said upper at said medial and lateral sides in an area corresponding to a wearer's ankle, said journals defining a journal axis of said upper of the boot;

at least one removable coupling assembly, coupling said upper to said shell base, said coupling assembly being arranged rearward of at least one of said journals, said coupling assembly being arranged on a side of a longitudinal medial plane of the boot, said removable coupling assembly being adapted to be removed and replaced with another coupling assembly having a different mechanical characteristic.

20. A sport boot according to claim 19, wherein:

said removable coupling assembly is positioned on said side of said longitudinal median plane of the boot; and on the other side of said longitudinal median plane of the boot no removable coupling assembly is positioned, whereby said upper is caused to advance in a direction divergent with respect to said longitudinal median plane.

21. A sport boot according to claim 19, wherein:

said removable coupling assembly is positioned on a medial side of said longitudinal median plane of the boot; and on a lateral side of said longitudinal median plane of the boot no removable coupling assembly is positioned, whereby said upper is caused to advance in a direction divergent with respect to said longitudinal median plane.

22. A sport boot according to claim 19, wherein:

said removable coupling assembly is positioned on a lateral side of said longitudinal median plane of the boot; and on a medial side of said longitudinal median plane of the boot no removable coupling assembly is positioned, whereby said upper is caused to advance in a direction divergent with respect to said longitudinal median plane.

23. A sport boot according to claim 19, wherein;

said at least one removable coupling assembly couples said collar of said shell base to said upper at a rear zone of the boot.

* * * * *